US006085767A

United States Patent [19]

Maslow

[11] Patent Number: 6,085,767

[45] Date of Patent: Jul. 11, 2000

[54] SHELTER

[76] Inventor: Brent Maslow, 465 Winchester St., Winnipeg Manitoba, Canada, R3J 2E8

[21] Appl. No.: 09/111,384

[22] Filed: Jul. 7, 1998

Related U.S. Application Data

[60] Provisional application No. 60/086,230, Sep. 26, 1997.

[51] Int. Cl.[7] ..... E04H 15/30

[52] U.S. Cl. ..... 135/95; 135/121; 135/157; 135/90; 135/91; 135/126; 224/154; 224/156; 224/153

[58] Field of Search ..... 135/95, 121, 157, 135/90, 91, 126; 224/154, 156, 153, 155; 52/2.22, 2.23

[56] References Cited

U.S. PATENT DOCUMENTS

| | | | |
|---|---|---|---|
| 1,411,272 | 4/1922 | Eaton | 135/90 |
| 1,412,302 | 4/1922 | Wittmann | 135/114 |
| 1,464,875 | 8/1923 | Hull et al. | 224/154 |
| 3,424,178 | 1/1969 | Yazaki | 135/157 |
| 3,822,813 | 7/1974 | Carter | 224/154 |
| 4,239,135 | 12/1980 | Armstrong | 224/154 |
| 4,526,307 | 7/1985 | Parker | 224/154 |
| 4,883,206 | 11/1989 | Miller | 224/153 |
| 5,042,517 | 8/1991 | Stewart | 135/90 |
| 5,072,465 | 12/1991 | Lyons, Jr. | 5/121 |
| 5,487,402 | 1/1996 | Clary | 135/87 |

*Primary Examiner*—Christopher T. Kent
*Assistant Examiner*—Jennifer I. Thissell
*Attorney, Agent, or Firm*—M. Williams; A. Battison; M. Thrift

[57] ABSTRACT

A tent structure convertible from a hanging tent to a ground-based tent is herein described. The tent structure includes a top portion having slots, T-shaped connectors stitched into the base portion and resilient rods having ends arranged to be inserted into either the slots or the T-shaped members. For use as a hanging tent, the ends of the resilient rods are inserted into connectors on opposite sides of the tent such that the resilient rods extend across the base portion of the tent and the tent is then hung from support structure(s). As a result of this arrangement, the base of the tent is firmly supported by the resilient rods and the tent is supported above the ground. For use as a ground-based tent, the connectors are pivoted such that the connectors are adjacent to the sides of the tent and the resilient rods are inserted one end into a connector and a second end into a slot such that the resilient rods extend along the sides of the tent and support the top portion of the tent above the ground. The tent includes a harness and is arranged to be rolled up and sealed so that the tent can be carried as a backpack.

9 Claims, 6 Drawing Sheets

SHELTER

This application is derived from Provisional Patent Application Ser. No. 60/086,230 filed on Sep. 26, 1997.

The present invention relates generally to the field of tents and shelters. More specifically, the present invention relates to a hanging tent convertible to a ground-based tent or a backpack.

BACKGROUND OF THE INVENTION

One of the more time-consuming chores associated with camping is the task of finding a suitable campsite. Specifically, the site must be relatively level and dry without many protruding rocks. In most cases, considerable time is spent finding an even marginally suitable campsite and then readying the ground such that it may be slept on. Clearly, a tent arranged to be suspended above the ground would eliminate the time and effort spent locating and preparing a suitable campsite. However, ideally, the tent would be designed to also function as a ground-based tent if ground conditions were right.

One other difficulty associated with camping is the task of transporting clothing, provisions and the tent itself while moving over rough terrain. All of these items must somehow be fit into backpacks and/or other tote bags which leads to a cumbersome load. Clearly, a tent arranged to be converted into a backpack and arranged to include storage compartments for storing clothing and/or other items is needed.

SUMMARY OF THE INVENTION

According to one aspect of the invention there is provided a tent attached to and supported by two adjacent support structures, said tent comprising:

an elongate member comprising ends, said ends attached to the two support structures such that the elongate member is held taut therebetween; and a tent structure comprising:

a top portion attached to the elongate member, said top portion arranged to depend downward from the elongate member;

sides extending downward from the top portion;

a base portion attached to the sides, said base portion including a support frame so that the base portion is arranged for supporting an individual thereon;

an interior defined by the top portion, the bottom portion and the sides for storing the individual therein; and openings for access to the interior, said tent arranged to be hung from the connecting member such that the base portion is suspended above the ground.

Preferably, the support frame comprises:

frame engagement members comprising an interior portion located within the base portion of the tent structure and an exterior portion arranged to project outward therefrom;

structural elements located within the base portion, said structural elements arranged to engage the interior portion of the frame engagement members; and resilient rods comprising ends, said ends connected to the exterior portions of frame engagement members on opposite sides of the base portion such that the resilient rods extend across the base portion.

The openings may include door flaps for closing the tent structure.

The openings may include mesh screens for keeping out insects and other pests.

Preferably, the support frame is collapsible for carrying the tent.

The tent structure may include a harness for carrying the collapsed tent like a backpack.

The base portion may include storage compartments. The storage compartments may be arranged so as to be accessible from the interior of the tent structure.

The top portion of the tent structure may include vents for aerating the tent and preventing moisture build-up.

According to a second aspect of the invention, there is provided a tent arranged for use as a hanging tent or as a ground-based tent, said tent comprising:

a top portion including rings for attaching cables thereto;

sides extending downward from the top portion;

a base portion attached to the sides;

at least one opening for entry into the tent structure;

a plurality of resilient rods having ends;

a plurality of slots along the top portion arranged for insertion of one end of one resilient rod therein; and a plurality of connectors mounted in the base portion at the junction of the base portion and the sides, said connectors having a first member within the base portion and a second member extending outwardly of the base portion, said second member arranged for insertion of one end of one resilient rod therein, said connectors arranged to pivot from a first position wherein the second member is adjacent to the base portion to a second position wherein the second member is adjacent to one of the sides, said tent convertible from a hanging tent wherein the connectors are pivoted to the first position and the ends of the resilient rods are inserted into the second members of the connectors on opposing sides of the base portion respectively such that the resilient rods extend across the base portion, thereby defining a tent with a supported base portion and cables are passed through the rings on the top portion for supporting the tent structure from supports such that the tent structure is suspended above the ground to a ground-based tent by removing the resilient rods, pivoting the connectors to the second position and inserting the ends of resilient rods into the second members of the connectors and the slots respectively such that the resilient rods extend along the sides, thereby supporting the top portion of the tent and forming a ground-based tent.

The opening may comprise a D-shaped door.

The top portion may include vents for aerating the tent and preventing moisture build-up.

The base portion may include storage compartments arranged to depend downward from the base portion.

The storage compartments be accessible from the interior of the tent structure.

The tent structure may include a harness for carrying the tent structure.

According to a third aspect of the invention, there is provided a backpack tent comprising:

a tent structure having:

a top portion;

sides extending downward from the top portion;

a base portion attached to the sides;

at least one opening into the tent structure; and a harness arranged to depend downward from the base portion, the backpack tent being arranged to be converted to a backpack by rolling the base portion of the tent structure up along the length of the tent and sealing an end of the base portion, thereby forming a backpack with a harness.

The backpack tent may include storage compartments mounted onto the base portion such that the storage compartments depend downward from the base portion.

The storage compartments may be accessible from the interior of the tent portion.

The backpack tent may include an overhang portion for covering the top of the backpack.

The end of the base portion may be sealed by zipper means.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
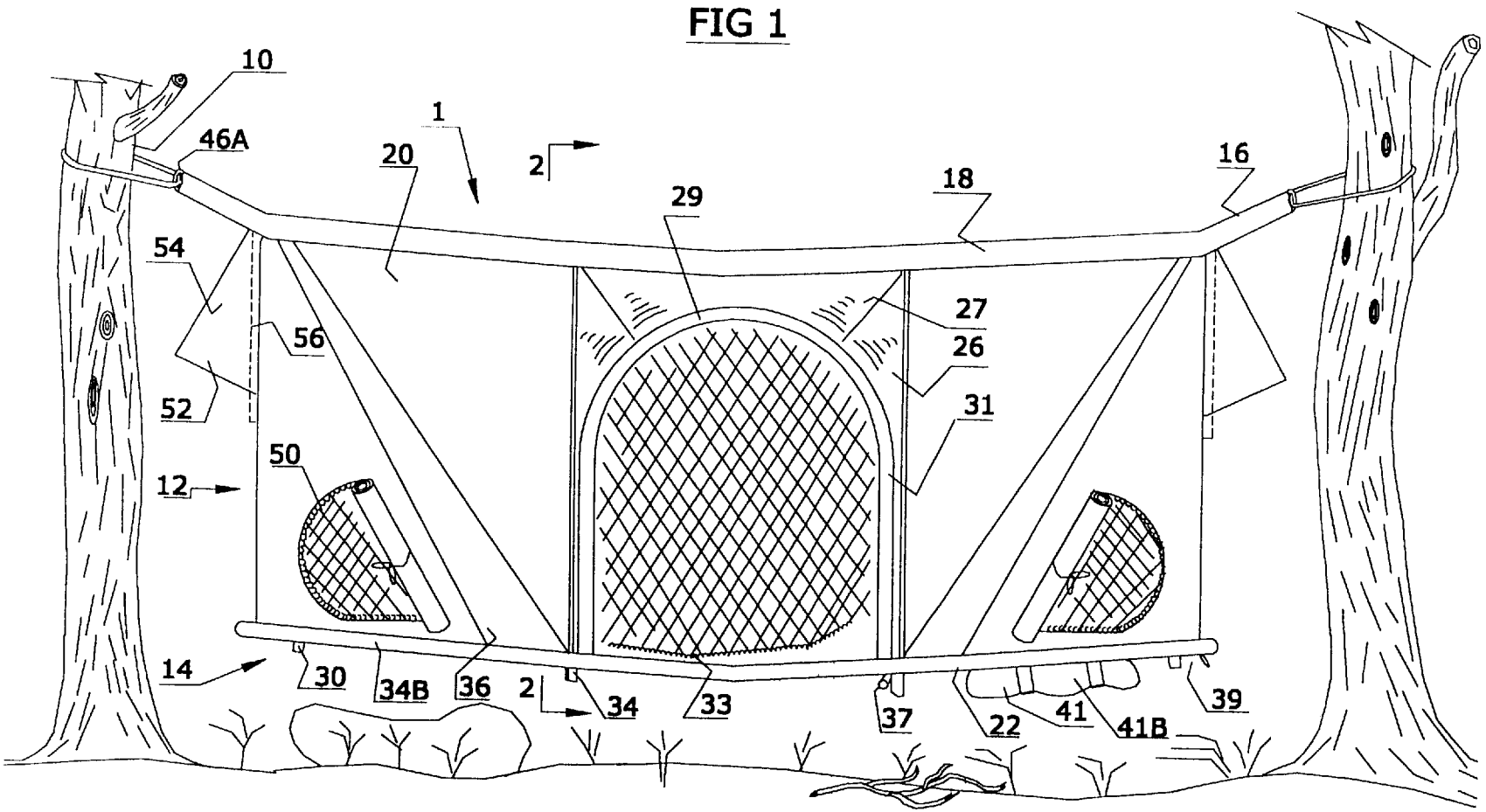
FIG. 1 is side elevational view of the tent arranged as a hanging tent.
Figure 2:
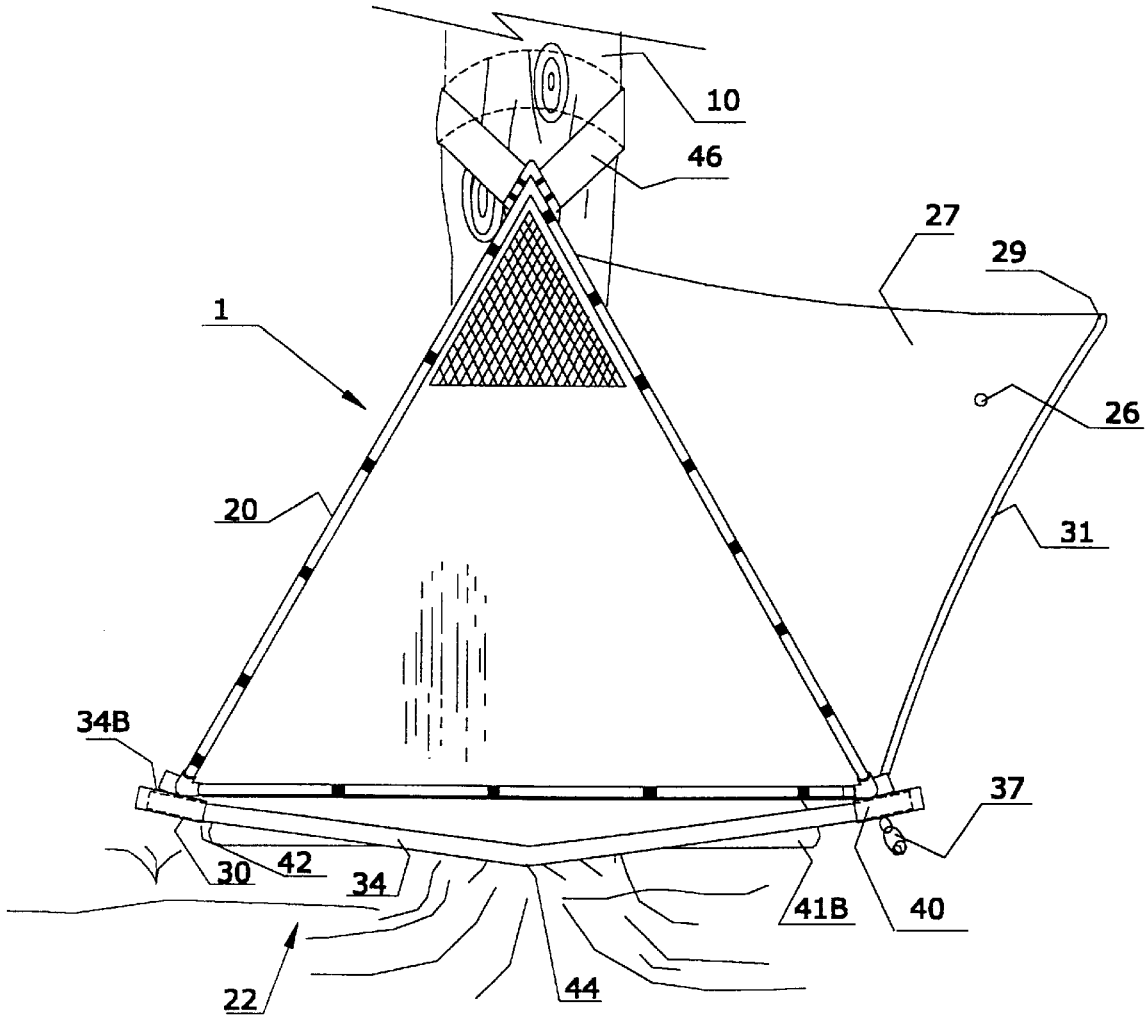
FIG. 2 is a vertical cross section the tent along the lines 2—2 of FIG. 1.
Figure 3:
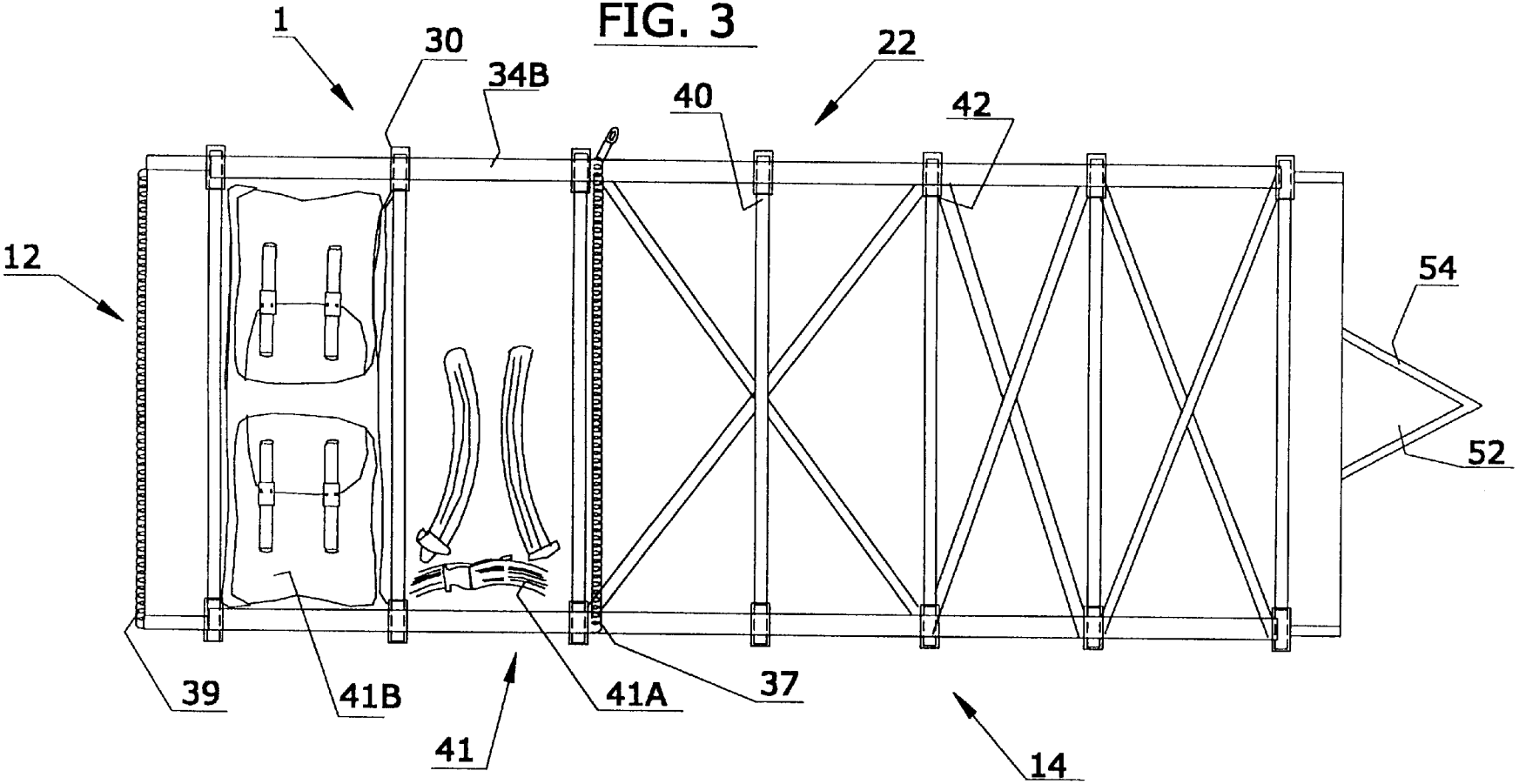
FIG. 3 is a bottom view of the tent.
Figure 4:
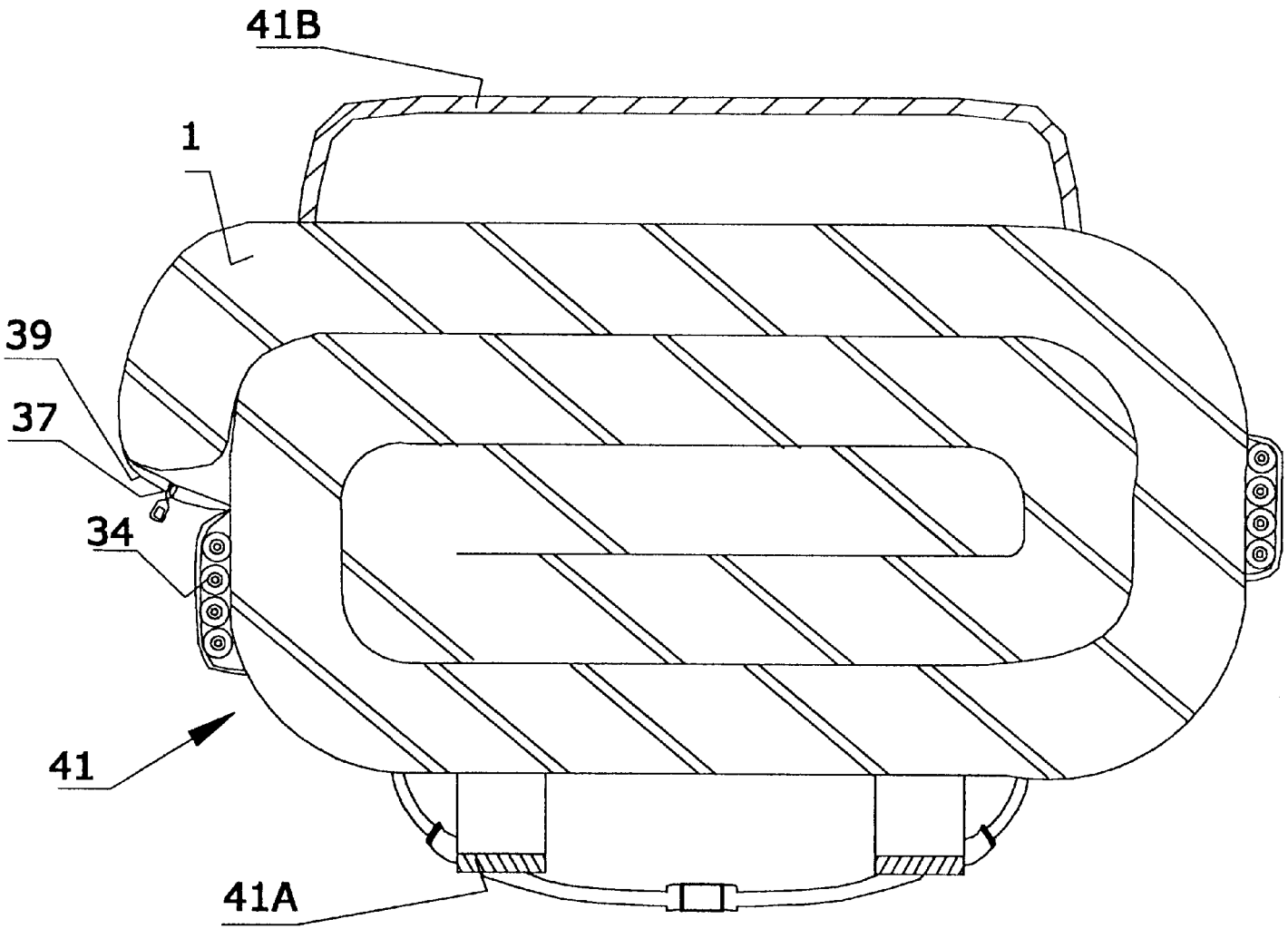
FIG. 4 is a vertical cross section of the tent arranged as a backpack.
Figure 5:
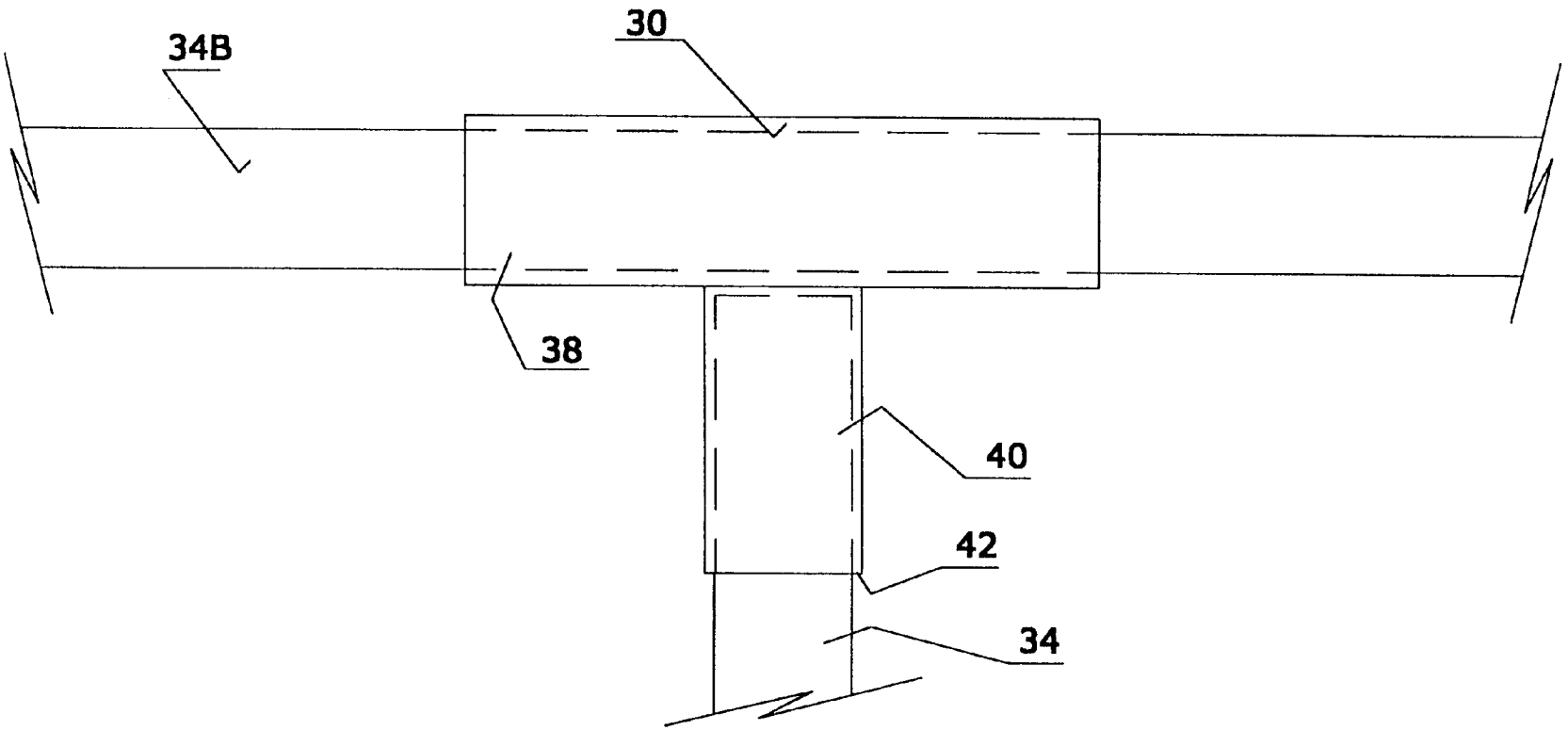
FIG. 5 is a top plan view of the T-shaped member.

Referring to the drawings, a tent 1 arranged to be suspended from two adjacent support structures 10 comprises a tent structure 12, a support frame 14 and cables 16.

The tent structure 12 comprises a top portion 18, sides 20 and a base portion 22. The top portion 18 includes rings for attaching cables 16 thereto such that the top portion 18 depends downward therefrom as described below. The sides 20 extend downward from the top portion 18 and terminate at the base portion 22. The top portion 18, the sides 20 and the base portion 22 define an inner bedding area 24 located within the tent structure 12 for sheltering an individual therein as described below. The tent structure 12 is arranged to include openings 26 for accessing the inner bedding area 24. The openings 26 may include door flaps for closing the tent structure 12. In this embodiment, the opening 26 comprises a D-shaped door 26 and is located on the side 20, the D-shaped door including an overhang end 27 which is supported by inserting a flexible rod 29 through the hollowed edge 31 to created an oval or D-shaped opening 26. The opening 26 has a zipper 33 which protects the occupant from the environment allowing the opening to be closed. The tent 1 includes a plurality of windows 50, each of which has a cover which can be opened so that the occupant can see out of the tent. The windows have a mesh in which keeps insects and the like out. A ventilation portion 52 is located on the top ends of the tent 1 to allow moisture to escape. The ventilation portion has a cover 54 which keeps rain and the like out and the ventilation portion has a mesh screen 56 to keep insects and the like out. In this embodiment, the tent structure 12 is composed of a water proof material, such as a fibre-reinforced plastic fabric. As shown in the drawings, in this embodiment, the tent structure 12 has a substantially triangular shape; however, it is of note that other arrangements are also possible, such as, for example, a rectangular tent, a square tent or an oval tent.

The support frame 14 comprises T-shaped members 30, resilient rods 34, a second resilient rods 34B, webbing 36 and a second webbing 36A. The T-shaped members 30 comprise ends 38 and a base 40. The T-shaped members 30 are stitched into the base portion 22 at positions adjacent to the sides 20 and the T-shaped members 30 are arranged such that the bases 40 of the T-shaped member 30 project outward from the base portion 22 while the ends 38 are located within the base portion 22. Specifically, each of the T-shaped members 30 are stitched into the base such that the T-shaped members pivot from a first position wherein the base 40 of the T-shaped member extends along the base of the tent 1 to a second position wherein the base 40 extends along the adjacent side of the tent for converting the tent 1 from a hanging tent to a ground-based tent as described below. Resilient rods 34B are inserted through the bottom edge of the base portion and continue through the ends 38 of the T-shaped members 30 to create increased support for the tent 1. It is of note that the resilient rods 34 are arranged to be of a length that is approximately the same as the width of the base portion 22 of the tent structure 12. The resilient rods 34 comprise ends 42 and a bowed portion 44. The ends 42 of the resilient rods 34 are fitted into the bases 40 of T-shaped members 30 on opposite sides of the base portion 22 of the tent structure 12 such that the resilient rods 34 extend across the base portion 22. Furthermore, the resilient rods 34 are arranged such that the bowed portion 44 is distal relative to the base portion 22. In this embodiment, the webbing 36 extends from the top ends of the top portion 18 at an angle to the opening 26, then extending upwards along side the opening to the top portion 18, thereby providing structural support to the tent structure 12 such that the structure is resistant to being stretched out of shape. To further increase the support, a second arrangement of webbing 36A extends across the base from a T-shaped member to the next T-shaped member. The webbing 36A is arranged such that the webbing crosses over and under creating an X arrangement across the base. Specifically, the webbing 36 and 36A act to distribute the weight of the inner bedding area 24. As a result of this arrangement, the support frame 14 retains its shape and therefore the shape of the tent structure 12 even when supporting the weight of an individual thereon as described below. It is of note that the resilient rods and the straps therefore form a structure having a shape similar to that of a bow.

The cables 16 are arranged to be fitted through the rings attached to the top portion 18 as described below. The cables 16 comprise ends 46 distal to the tent structure 12 and the cables 16 are arranged to be attached to two adjacent support structures 10 as described below.

For use as a hanging tent, the tent 1 is assembled as follows. The resilient rods 34B are inserted through the bases of T-shaped members 30 along the base portion 22 of the tent so that the resilient rods 34 create a continuous support arrangement along the sides. The resilient rods 34 are then inserted into the bases 40 of opposing T-shaped members 30 such that the resilient rods 34 extend across the base of the tent 1, thereby supporting the base portion of the tent. In this manner, the support structure 14 is quickly and easily assembled. Next, two suitable adjacent support structures 10, such as, for example, two trees, are selected and the cables 16 are then connected to the support structures 10 such that the tent structure 12 depends downward from the cables 16. That is, the tent structure 12 is supported by the cables 16 such that the bottom portion 22 is above the ground.

As noted above, the tent 1 may be collapsed for easy carrying by disengaging the rods 34B from the ends of the T-shaped members 30 and removing the resilient rods 34 from the bases 40 of the T-shaped members. It is of note that, as a result of this arrangement, the tent 1 collapses, resulting in a more compact structure for easier carrying. In an embodiment wherein the collapsed tent is arranged to be carried as a backpack 41, the tent structure includes securing means for keeping the collapsed tent compact. The tent 1 can be rolled up such that the zipper 37 and the zipper receive 39 meet and can be fastened creating the form of the back pack.

The back pack is situated so it forms part of the base of the tent. That is, the backpack straps 41A are located on a portion of the base and the bags 41 B of the backpack 41 are located on a portion of the base such that the backpack 41 is arranged to be part of the tent structure and that no pieces of the tent are unused. In this embodiment, the tent structure 12 includes carrying means such as, for example, a shoulder harness or straps for carrying the collapsed tent like a backpack 41. Furthermore, the resilient rods 34 may be used to form the frame for the backpack 41 thereby facilitating carrying of the collapsed tent. The backpack 41 may also include a cap portion situated to keep the tent and other contents secure. In this embodiment, the tent structure 12 may include storage compartments extending from the base portion 22 of the tent 1 for carrying items such as clothing. The storage compartments may be located proximal to one end of the tent structure 12. As a result of this arrangement, items stored in the storage compartments may be used effectively as a pillow by an individual in the bedding area. Furthermore, the storage compartments are arranged to depend downward from the base portion 22 of the tent 1 and the base portion 22 may include openings for accessing the storage compartments from within the bedding area 24.

In operation, the user enters the inner bedding area 24 through the opening 26 in the tent structure 12. As the user lies on the base portion 22 of the tent structure 12, the support frame 14 provides the rigidity necessary for the base portion 22 to retain its shape. Specifically, the webbing 36 of the support frame 14 stabilize the tent structure 12 such that the tent structure 12 does not stretch as a result of the weight applied thereon. Furthermore, as noted above, the T-shaped members 30 are anchored within the base portion 22 the resilient rods 34B remain in place, thereby maintaining the rigidity of the support frame 14. Thus, the support frame 14 distributes the weight of the user such that the tent 1 is stably suspended by the elongate member 16. As a result of this arrangement, the tent 1 may be used when camping on any type of terrain, such as rocky ground, wet ground, uneven ground or thick brush, without the need to prepare the camp site, as the tent 1 is suspended above the ground.

In alternative arrangements, the tent structure 14 may include ties extending from the base portion 22. Specifically, the ties may be used to connect the tent 1 to additional support structures for stabilizing the tent 1 and for further distributing the weight in the inner bedding area 24 of the tent 1. Alternatively, the tent 1 may be arranged such that the inner bedding area 24 is supported by the ties and the elongate member 16 simply holds the top portion 18 of the tent 1 above the base portion 22.

Figure 6:
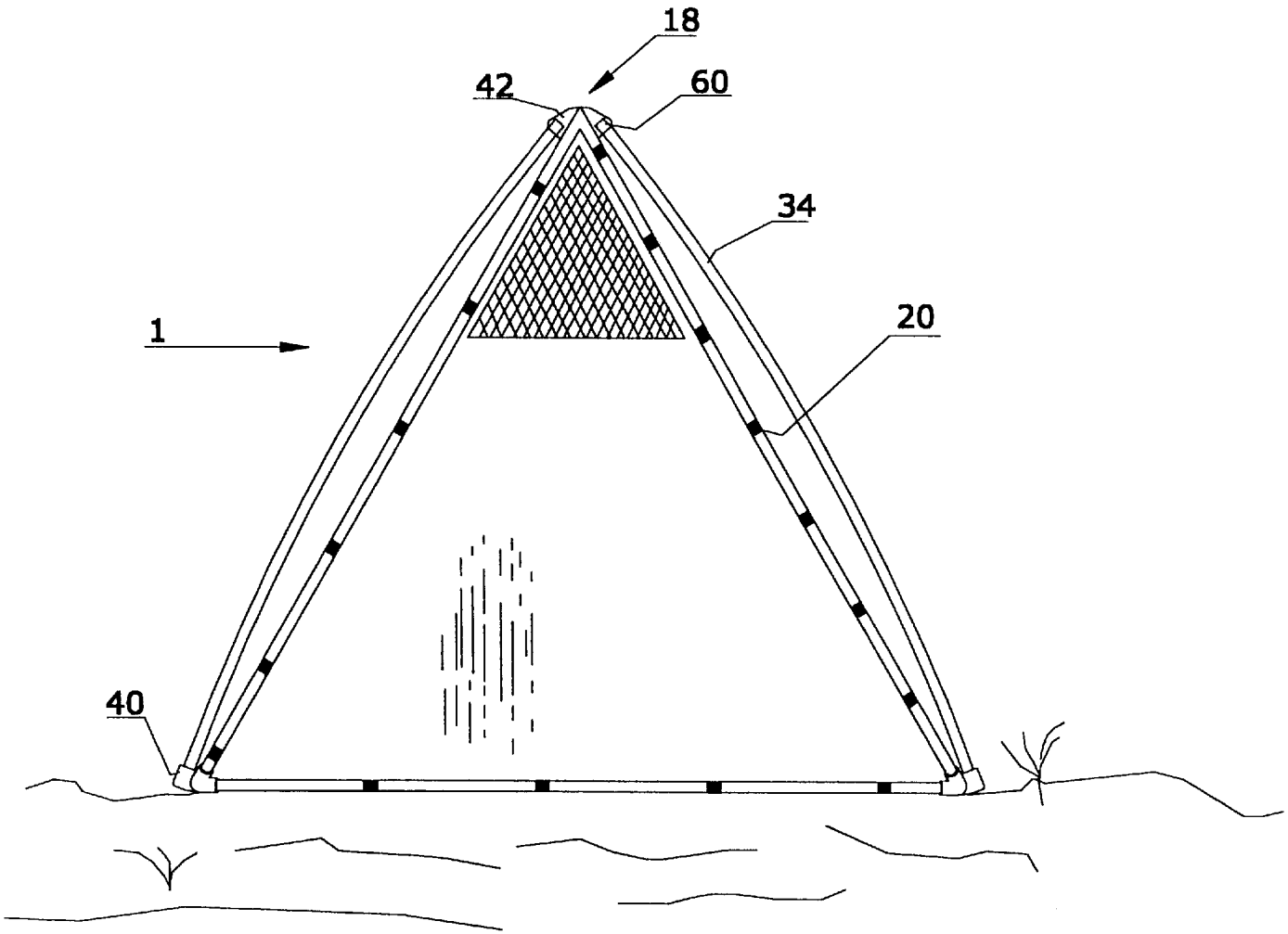
FIG. 6 is a side view of the tent arranged as ground-based tent.

In an alternative embodiment, wherein the tent 1 is arranged for use as a ground-based tent, the top portion 18 of the tent 1 includes slots 60 arranged to accept the ends of the resilient rods 34 therein. In this arrangement, the T-shaped members are pivoted to the second position such that the base 40 of each T-shaped member is adjacent to the respective side 20 of the tent. The resilient rods 34 are then inserted a first end 42 into a slot 60 and a second end 42 into the base 40 of the T-shaped member such that the resilient rods 34 extend along the respective sides 20 of the tent 1 and support the top portion 18 of the tent 1 above the ground, as shown in FIG. 6. As a result of this arrangement, the sides 20 of the tent 1 are supported by the resilient rods 34 such that the tent is a free-standing structure. The slots 60 may comprise a fabric member having a substantially U-like shape arranged such that each arm of the U is attached to one side 20 of the tent, wherein the arms of the U are arranged to accept the ends 42 of the resilient rods 34 therein. Alternatively, the T-shaped members 30 or other suitable connectors may be stitched into the top portion 20 and used to connect the ends 42 of the resilient rods 34.

It is of note that the lengths and widths of the various components of the tent 1 may be varied as desired. Furthermore, while the above-described tent 1 has a substantially triangular shape, other arrangements, such as, for example, a square tent, a rectangular tent or an oval tent, are possible by varying the number and location(s) of the elongate member(s).

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A tent for attachment to two adjacent support structures, said tent comprising:

an elongate member having ends, said ends arranged for attachment to the two support structures such that the elongate member is held taut therebetween; and a tent structure comprising:

a top portion attached to the elongate member, said top portion depending downward from the elongate member;

sides extending downward from the top portion;

a base portion attached to the sides extending between the sides;

a support frame comprising:

a plurality of first T-shaped connectors having tops and legs, each of the first connectors mounted to the base such that the top of each of the first connectors is inserted in the base and aligned with one another along a first side of the base and the leg of each of the first connectors is at a right angle to the top, said legs extending towards a second side of the base;

a plurality of second T-shaped connectors having tops and legs, each of the second connectors mounted to the base such that the top of each of the second connectors is within the base and aligned with one another along the second side of the base and the leg of each of the second connectors is at a right angle to the top, said legs extending towards the first side of the base, a respective one of the second T-shaped connectors being directly opposite a respective one of the first connectors; and a plurality of rods, each of the rods having a first end inserted into the leg of a respective one of the first connectors and a second end inserted into the leg of a respective one of the second connectors such that the rod extends across the base of the tent;

an interior defined by the top portion, the bottom portion and the sides for storing an individual therein; and openings for access to the interior, wherein said tent hangs from the elongate member such that the base portion is suspended above the ground and the support frame supports an individual positioned on the base of the tent.

2. The tent according to claim 1 wherein the support frame is collapsible for carrying the tent.

3. The tent according to claim 1 including storage compartments accessible from the interior of the tent structure.

4. The tent according to claim 1 wherein the support frame includes structural elements placed through the aligned tops of the first connectors and through the aligned tops of the second connectors.

5. A tent for use as a hanging tent or as a ground-based tent, said tent comprising:

a top portion including rings for attaching cables thereto;

sides extending downward from the top portion;

a base portion attached to the sides and extending therebetween;

at least one opening for entry into the tent structure;

a plurality of resilient rods having ends;

a plurality of slots on sides of the top portion; and a plurality of T-shaped connectors inserted in the base portion at the junction of the base portion and first and second sides of the tent respectively, each T-shaped connector having a top inserted in the base portion along the first side and the second side of the tent respectively and a leg at right angle to the top extending outwardly from the base portion, second member arranged for insertion of one end of one resilient rod said tops being aligned along the respective side of the tent, said legs being moveable from a first position wherein the legs are adjacent to the base portion to a second position wherein the legs are adjacent to the first or second side of the tent, wherein the tent is convertible from a hanging tent wherein the legs are pivoted to the first position and the ends of each of the resilient rods are inserted into the legs of the connectors on the first side and the second side respectively of the base portion such that the resilient rods extend across the base portion, forming a tent with a supported base portion and cables are passed through the rings on the top portion for supporting the tent structure from supports such that the tent structure is suspended above the ground to a ground-based tent wherein the connectors are moved to the second position and the ends of resilient rods are inserted into the legs of the connectors and the slots respectively such that the resilient rods extend along the sides, supporting the top portion of the tent and forming a ground-based tent.

6. The tent according to claim 5 including storage compartments accessible from the interior of the tent structure.

7. The tent according to claim 5 including structural elements placed through the aligned tops of the connectors.

8. A backpack tent having a first condition wherein the backpack tent is a tent having:

a tent structure having:

top portion;

sides extending downward from the top portion;

a base portion attached to the sides and extending therebetween;

a zipper extending across the width of the base portion;

a zipper receive extending across the width of the base portion located at a distance to the zipper;

a harness depending downward from the base portion said harness located between the zipper and the zipper receive; and at least one opening into the tent structure; and rods for supporting the tent, and a second condition wherein the backpack tent is a backpack comprising:

the tent structure rolled up such that the zipper and the zipper receive are adjacent one another and interlocked and the harness is exposed; and the rods inserted into the tent structure forming a frame for the backpack.

9. The backpack tent according to claim 8 including storage compartments mounted on the base portion, said storage compartments depending downward from the base portion and being accessible from the interior of the tent portion.

* * * * *